US005833446A

United States Patent [19]

Smith et al.

[11] Patent Number: 5,833,446

[45] Date of Patent: Nov. 10, 1998

[54] DERIVING MECHANICAL POWER BY EXPANDING A LIQUID TO ITS VAPOUR

[75] Inventors: Ian Kenneth Smith, London; Nikola Rudi Stosic, Barnet, both of United Kingdom

[73] Assignee: Carrier Corporation, Syracuse, N.Y.

[21] Appl. No.: 783,976

[22] Filed: Jan. 15, 1997

[30] Foreign Application Priority Data

Jan. 31, 1996 [GB] United Kingdom ..... 9602191

[51] Int. Cl.[6] ..... F25B 1/00

[52] U.S. Cl. ..... 418/201.1; 60/530; 62/116

[58] Field of Search ..... 62/50, 3, 116, 62/498; 60/530, 531; 410/201.1, 259

[56] References Cited

U.S. PATENT DOCUMENTS 4,235,079 11/1980 Masser ..... 62/116

4,794,752 1/1989 Redderson ..... 60/531

*Primary Examiner*—William Wayner

[57] ABSTRACT

An apparatus is provided for deriving mechanical power from expansion of a working fluid, other than water, from a liquid state at a first pressure to vapour at a second, lower pressure, which apparatus includes positive displacement machinery, wherein the in-built volumetric expansion ratio of the positive displacement machinery is between 10 and 50% of the overall volume ratio of expansion experienced by the fluid in the pressure reduction between the entry and the exit of the machinery.

4 Claims, 9 Drawing Sheets

DERIVING MECHANICAL POWER BY EXPANDING A LIQUID TO ITS VAPOUR

This invention relates to a method and apparatus for deriving mechanical power from expansion of a liquid or wet vapour into vapour by means of positive displacement machinery.

The term positive displacement machinery used herein refers to a machine or a series of two or more machines in which, or in each of which, at least one chamber for containing a working fluid cyclically undergoes the following steps: to receive a charge of working fluid, to be closed, to have its volume increased or decreased, to be opened for release of the charge of working liquid and thereafter to have its volume decreased or increased respectively to the value obtaining at the start of the cycle. The built-in volumetric expansion ratio as used herein in respect of a positive displacement machine used as an expander is the ratio of the maximum volume of a working chamber, just prior to its opening, to the volume thereof at the instant the chamber is closed.

Where the machinery consists of two or more positive displacement machines arranged in series, the built-in volumetric expansion ratio of the machinery is the product of the built-in volumetric expansion ratios of the individual machines.

It is well known that most positive displacement machines which are used as compressors may also operate in the reverse manner as expanders to produce mechanical power output. Thus, typically, twin screw, single screw, scroll, vane and reciprocating machines have all been proposed or operated in this manner.

In many cases, however, when operating as expanders such machines have achieved far lower efficiencies than those anticipated, especially when they have been used to expand saturated liquids or wet vapours. U.S. Pat. No. 3,751,673 (Sprankle) disclosed the concept of using a Lysholm twin screw machine to expand pressurised hot water in the form of geothermal brines. In this case, despite a major research programme, maximum adiabatic efficiencies of little over 50% were achieved when values of up to 75% were anticipated, see Kestin, J "Sourcebook on the production of electricity from geothermal energy" DOE/RA/28320-2, August 1982; Steidel, R F, Weiss, H and Flower, J E "Characteristics of the Lysholm engine as tested for geothermal applications in the Imperial Valley" J Eng for Power, v 104, pp 231–240, January 1982; and LaSala, R J, McKay, R. Borgo, P A and Kupar, J "Test and Demonstration of 1-MW Wellhead Generator: Helical Screw Expander Power Plant, Model 76-1 " Report to the International Energy Agency. DOE/CE-0129 U.S. Department of Energy Div of Geothermal and Hydropower Technology, Washington, D.C. 20585, 1985.

According to the present invention there is provided apparatus for deriving mechanical power from expansion of a working fluid, other than water, from a liquid state at a first pressure to vapour at a second, lower pressure, the apparatus including positive displacement machinery, wherein the in-built volumetric expansion ratio of the positive displacement machinery is between 10 and 50% of the overall volume ratio of expansion experienced by the fluid in the pressure reduction between the entry and the exit of the machinery.

The exclusion of water arises from its very high volumetric expansion ratio from the liquid to the vapour state, being of the order of several thousands at normal power plant condensation temperatures.

The invention will now be further described by way of example with reference to the accompanying drawings, in which.

Figure 1:
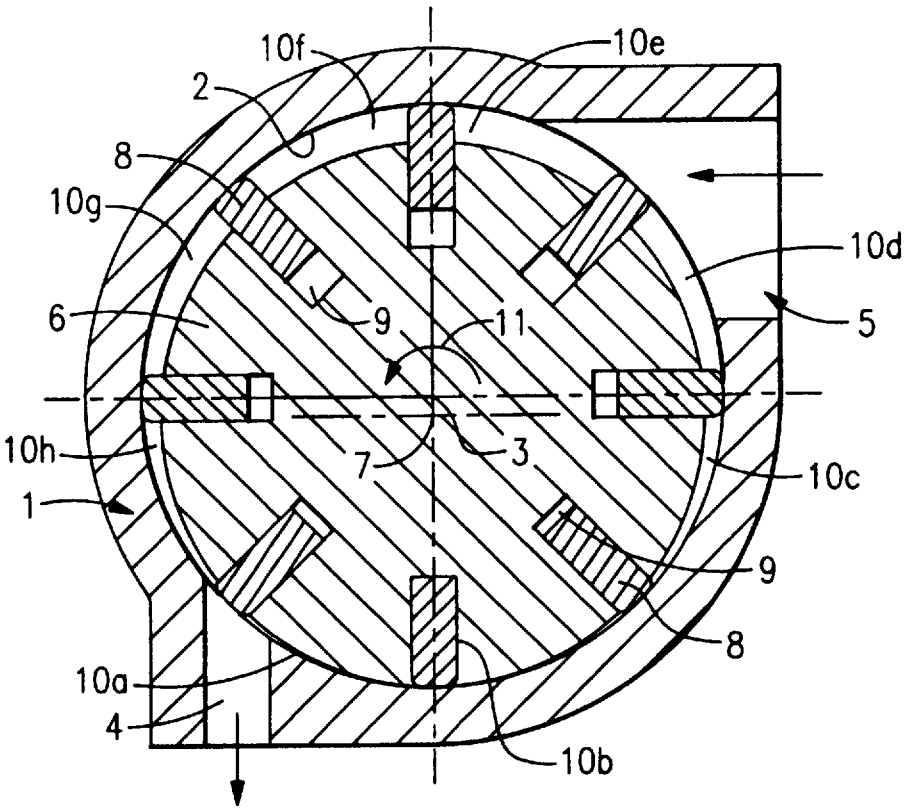
FIG. 1 is a diagrammatic cross-sectional view of a vane-type compressor.

FIG. 1 shows diagrammatically a conventional vane-type compressor as one example of a positive displacement machine. Other examples are Lysholm screw machines mentioned above, single screw compressors, constrained-vane compressors, scroll-type compressors and reciprocatory piston and cylinder machines. The compressor shown has a stator housing 1 with a cylindrical interior 2 having an axis 3, a smaller port 4 forming the compressor outlet and a larger port 5 forming the inlet.

A cylindrical rotor 6 of smaller diameter than the interior 2 is mounted for rotation therein about an axis 7 parallel to, but spaced from, the axis 3. Vanes 8 are slidable in equi-spaced pockets 9 in the rotor and as the latter rotates are thrown outwards to make sealing contact with the inner wall of the housing and thus divide the spaced between the rotor 6 and housing 1 into a set of working chambers 10*a*–10*h*, the volume of each of which varies from a minimum between positions 10*a* and 10*b* to a maximum between positions 10*e* and 10*f*. When used as a compressor, the rotor is driven in the direction of the arrow 11. When used as an expander, the port 4 forms the inlet and the port 5 the outlet and the rotor is caused to rotate in the opposite direction.

Figure 2:
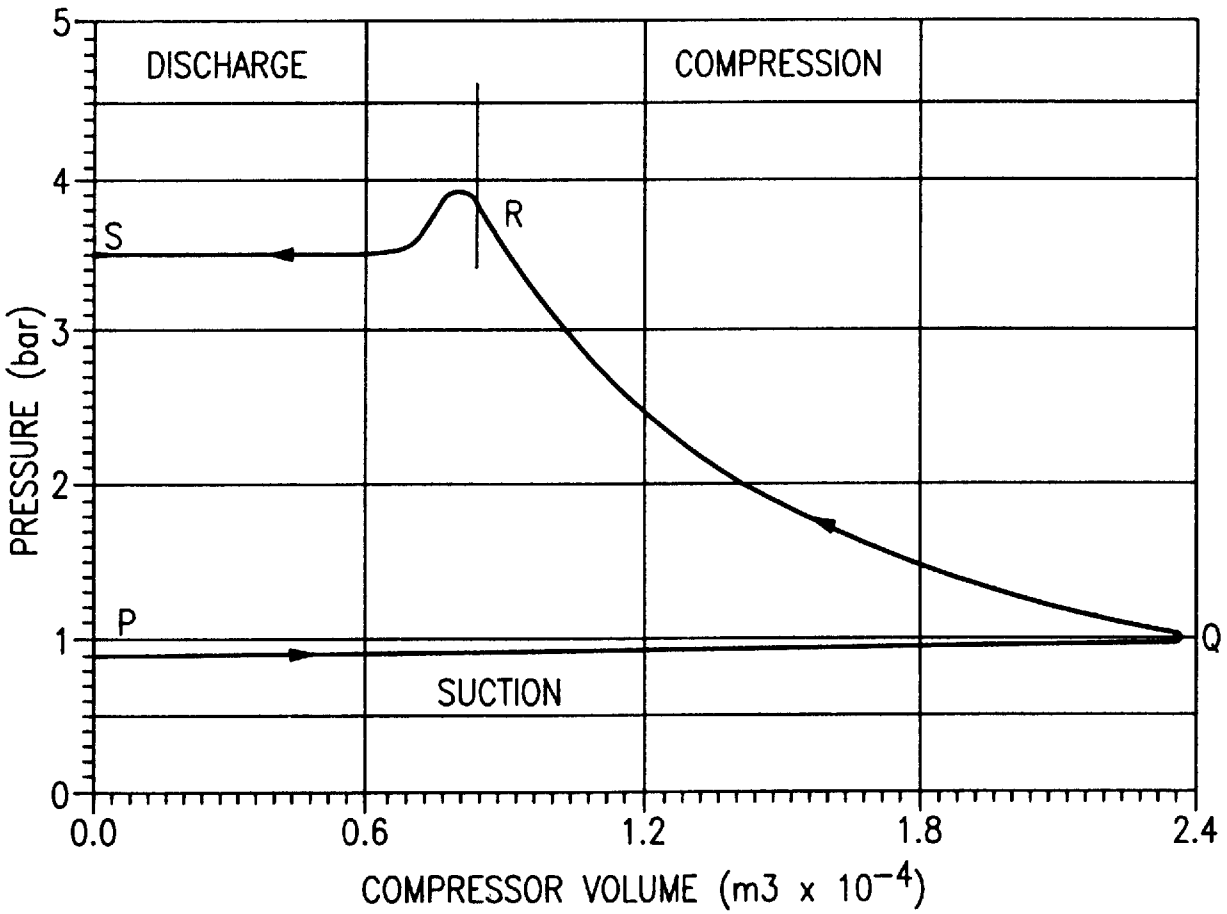
FIG. 2 is a graph showing the variation of pressure with the varying volume of a working chamber of a compressor in normal operation.

In use as a compressor, the processes involved in gas or vapour compression follow the path shown in FIG. 2. Induction of the working fluid takes place at approximately constant pressure (range PQ) at a value slightly less than in the inlet port or manifold 5, followed by compression (range QR) by reduction of volume (RS) to the desired discharge pressure and then discharge at approximately constant pressure which is slightly higher than that in the delivery manifold. The pressure differences between the inside and outside of the machine during suction and discharge are relatively small and may, as a first approximation, be ignored.

The mass flow rate through the machine is largely determined by the swept volume of the machine. In practice, the true induced volume is slightly less than the swept value due to backward leakage of fluid between the vanes, rotors or piston and the casing into the filling volume which is induced by the pressure gradient created by the compression process. This difference is expressed as a volumetric efficiency or ratio of volume of fluid induced to the swept volume in the machine during the filling process. In screw type compressors, where the clearance volume is negligible, this may be of the order of 95%.

Figure 3:
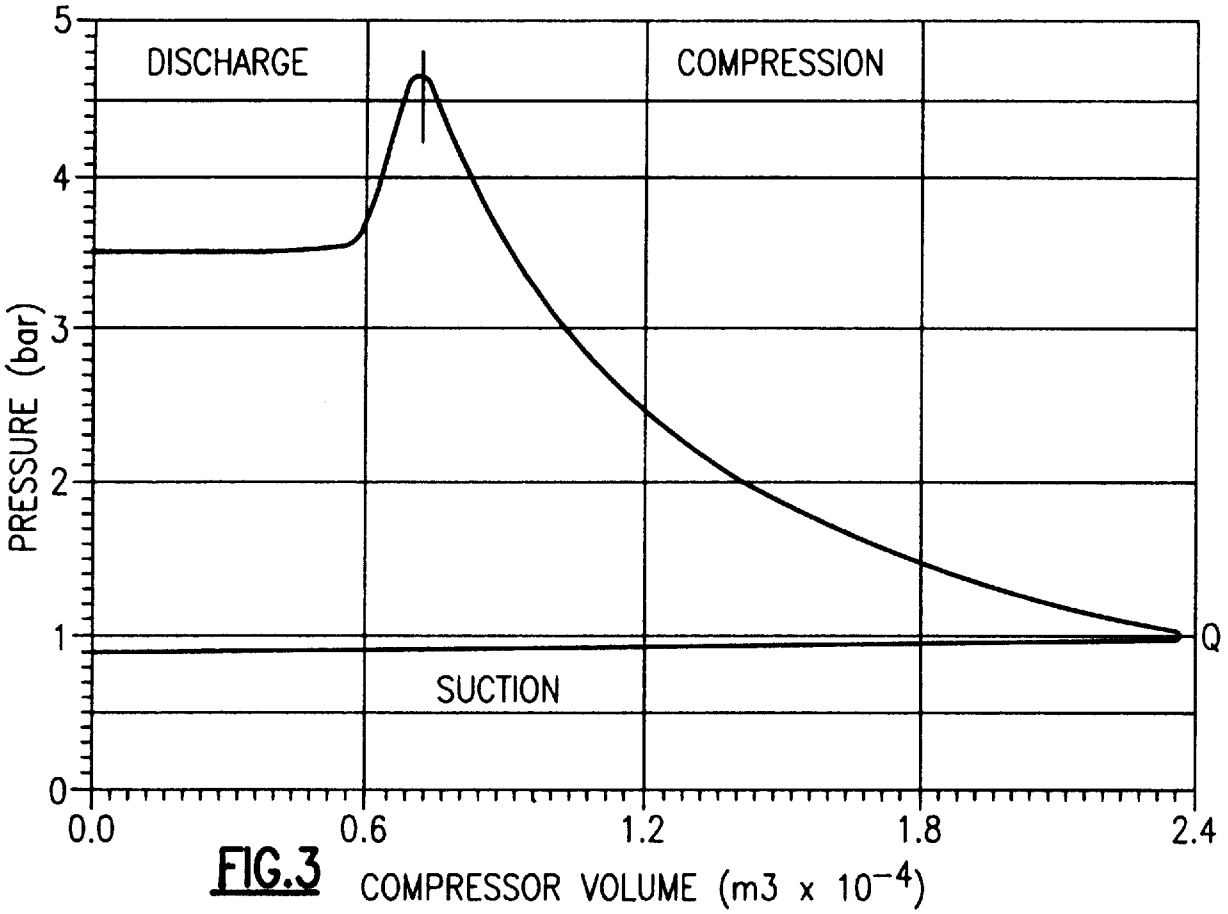
FIGS. 3 and 4 are graphs corresponding to FIG. 2, showing the effects respectively of over- and under-pressurisation in a compressor.
Figure 4:
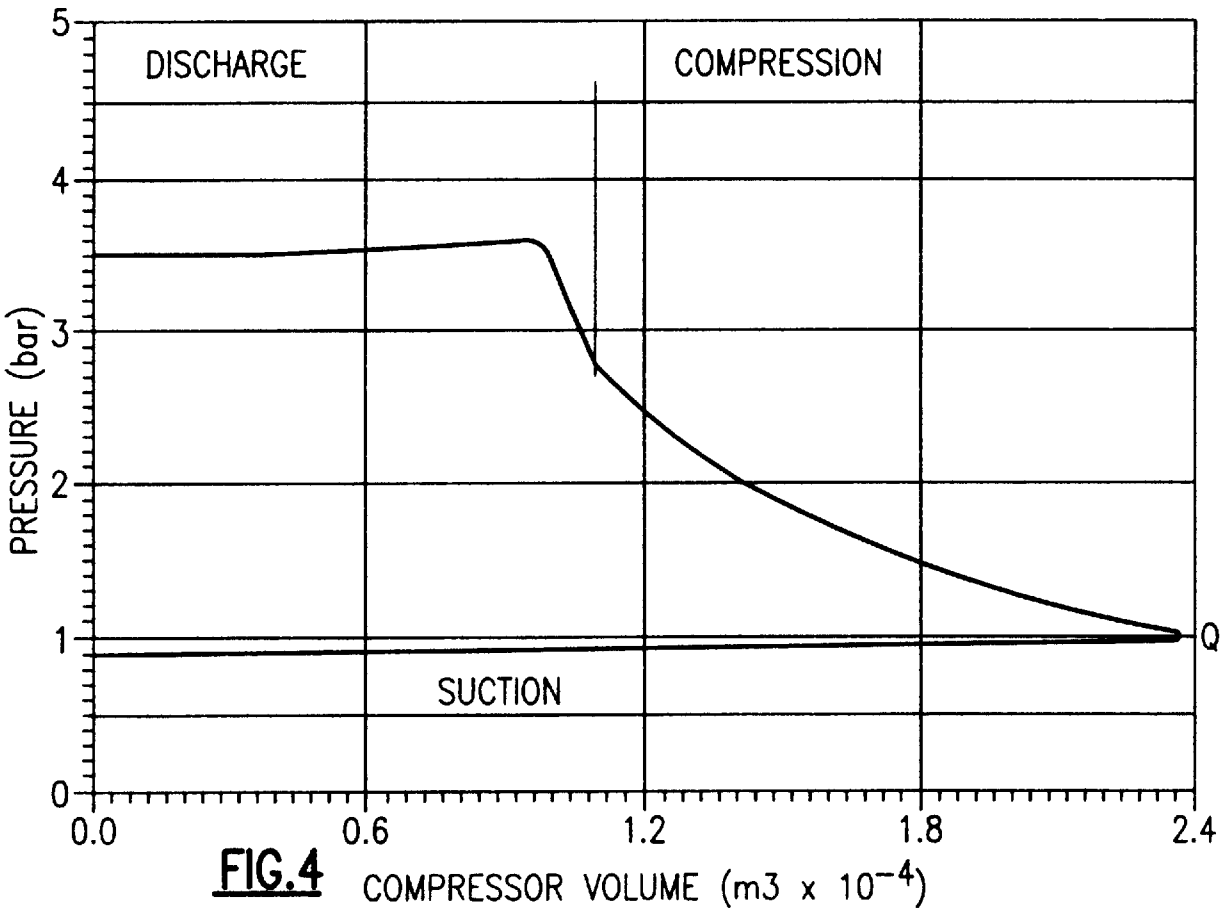

For compressors, the built in volume ratio may be selected approximately as the value required to raise the pressure from suction to discharge values according to the pressure-volume relationship appropriate to the compression process assumed i.e with or without liquid injection or external heat transfer. If the assumed value is incorrect, there will be either over pressurisation of the fluid, as shown in FIG. 3, or under pressurisation, as shown in FIG. 4, at the position (R) in the compression process where the discharge process commences. In both cases, the effects on the compressor performance and efficiency will be relatively small.

Figure 5:
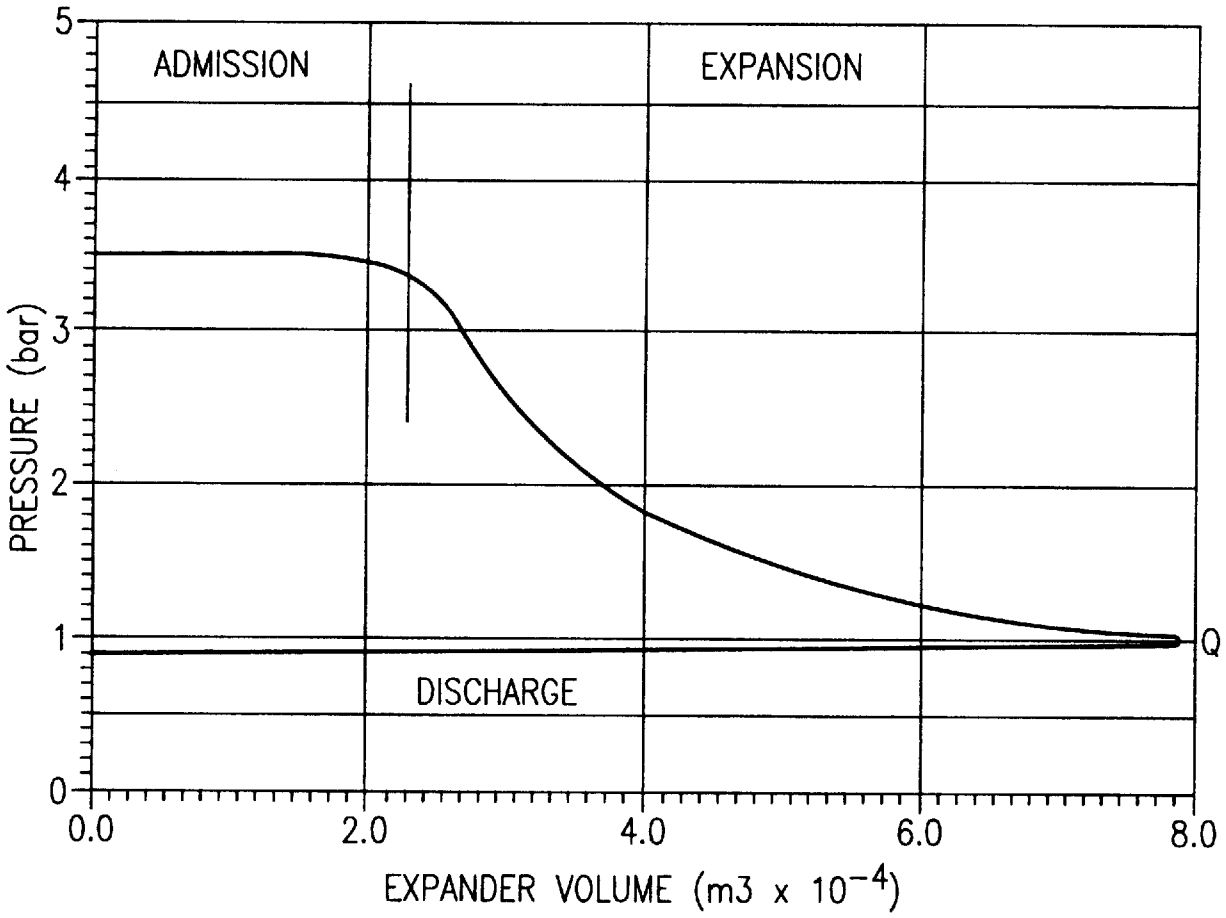
FIG. 5 is a graph showing the expected performance of a positive displacement machine used for expanding a liquid in accordance with the prior art.

In the case of positive displacement machines used as expanders, a rational starting point for design would be to assume the sequence of processes involved to be approximately the reverse of those of the compressor, as shown in FIG. 5. More detailed analysis in connection with the invention has however shown that the path of the processes in an expander differs significantly from that in a compressor, especially where the working fluid enters the machine as a saturated liquid or wet vapour, and that the optimum value of built in volumetric expansion ratio differs far more from that required to effect the reverse pressure change in a compressor than could be reasonably anticipated from simplified analyses. Moreover, selection of the wrong value has profound effects on the size, speed and efficiency of the expander.

Figure 6:
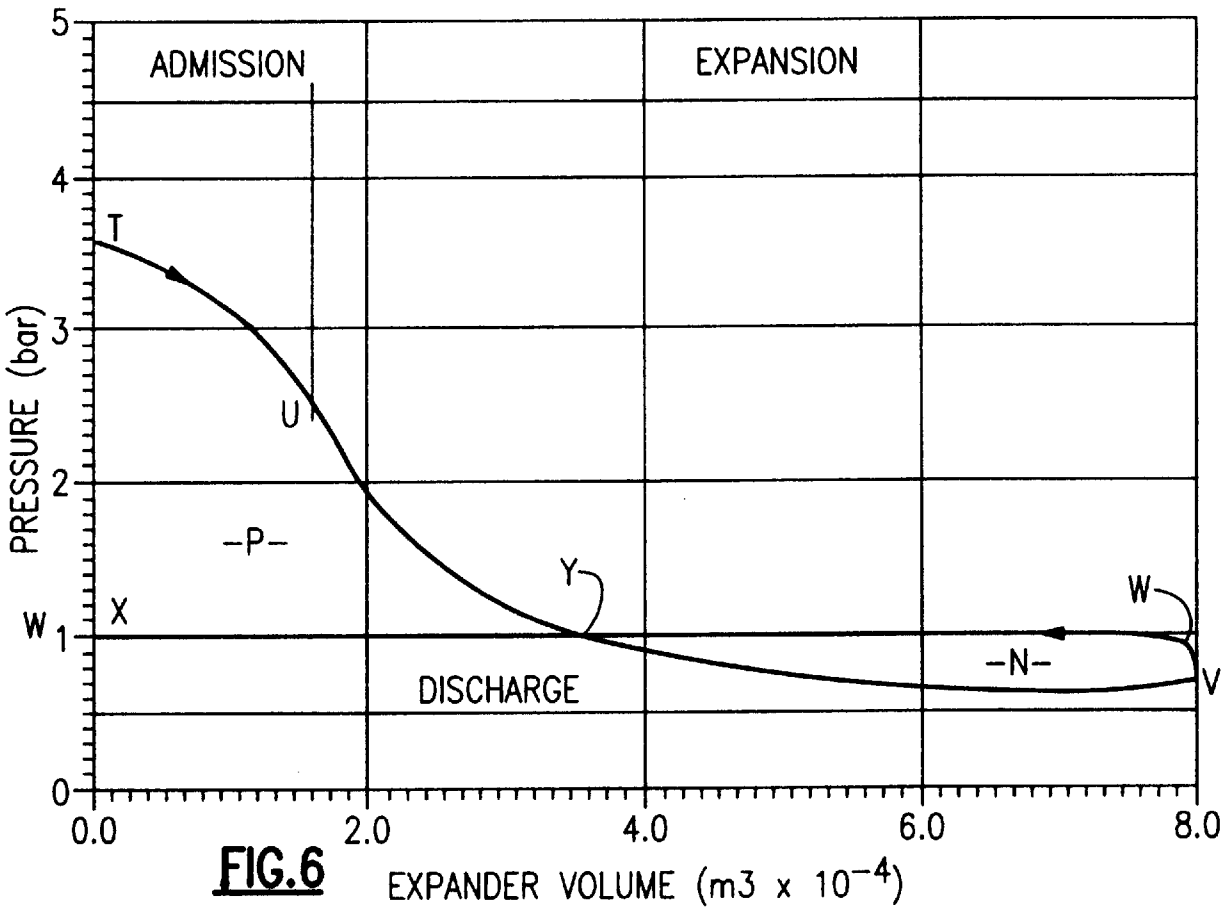
FIG. 6 is a graph showing the actual performance achieved by the prior art.
Figure 7:
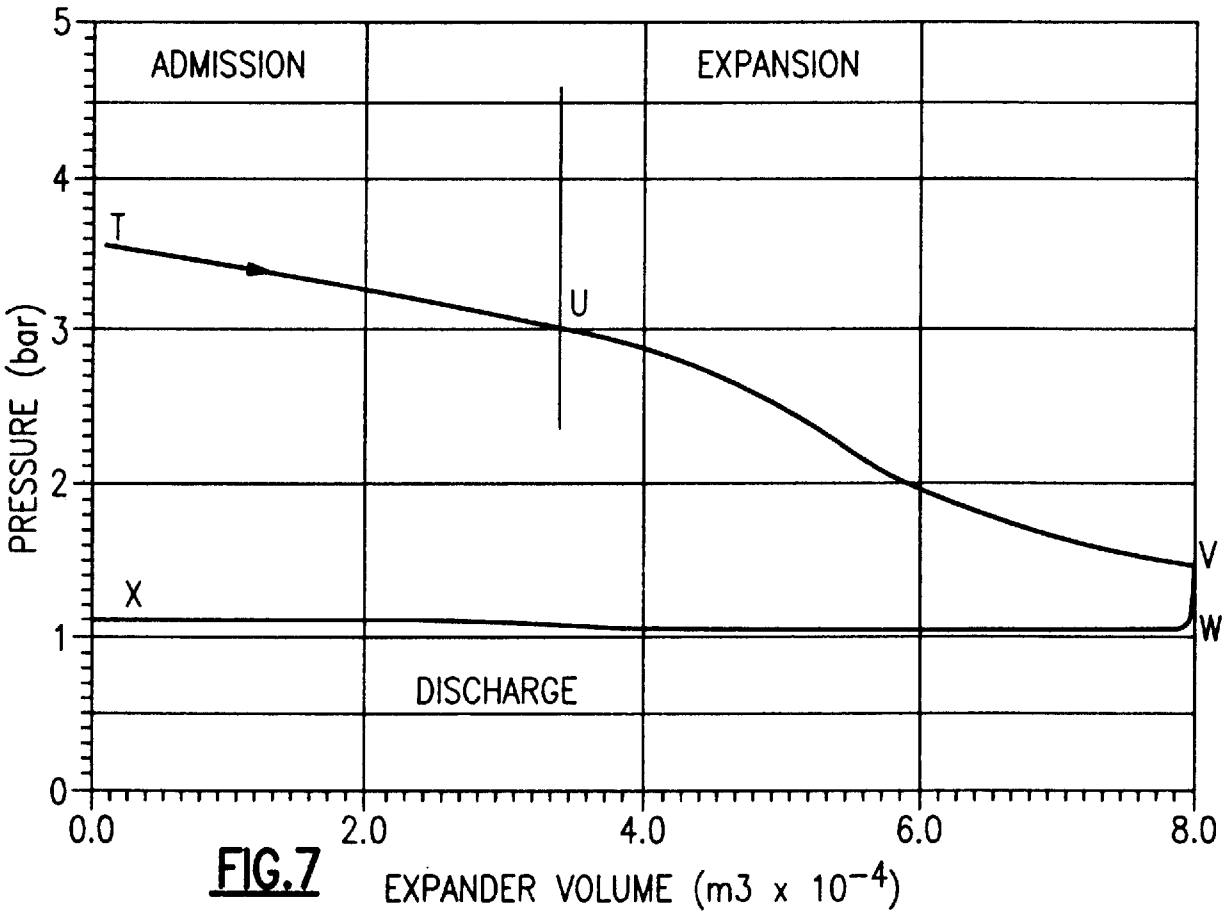
FIG. 7 is a graph shown the performance achieved by applying the invention.

Differences between the processes deduced from the reversed compressor assumption shown in FIG. 5 may be inferred from FIGS. 6 and 7. As may be seen, the discrepancies are large. The reasons for this may be explained as follows:

Firstly, it may be seen that the filling process TU is associated with a significant decrease in pressure, and hence, expansion. This is because the fluid accelerated through the inlet port gains momentum. This momentum increase is much larger for wet fluids than for gases because the wet fluids are much denser.

Secondly, since fluid is admitted at the high pressure end of the machine, it follows that the mass of fluid induced is highly dependent on the built in volumetric expansion ratio and increases as the volume ratio is decreased. In this case, leakage occurs in the same direction as the bulk flow of fluid. Thus, fluid would expand through the clearances between the vanes, rotors or pistons and casing even if the expander rotor was not rotating or the pistons not being displaced. Consequently, the volume flow rate induced is greater than that swept out by the vanes, rotors or pistons during the filling process. The leakage rate is dependent mainly on the clearances between the vanes, rotors or pistons and the casing and largely independent of the built in volumetric expansion ratio and speed. It follows that if the built-in volumetric expansion ratio decreased, then the leakage becomes a smaller percentage of the total flow and hence its effect on the machine performance is reduced.

Additionally, as the speed of the expander is increased, the momentum gain of the fluid in passing through the inlet port becomes greater. Hence the pressure drop and expansion associated with the filling process increases. The density of the fluid induced is therefore reduced and so the mass flow through the machine does not increase as rapidly as might be expected by increasing the machine speed.

In FIG. 6 the expansion in the filling process is so great that the fluid has overexpanded (YV) before the discharge process begins. This overexpansion may be caused either by operating the expander at too high a speed or by having too large a built-in volumetric expansion ratio. Whatever, the cause, it may be clearly seen that it greatly reduces the area of positive work (P) and further creates a large area of negative work (N) on the pressure-volume diagram and hence has a doubly adverse effect on the expander efficiency which is much greater than an equivalent overpressurisation in a compressor.

In FIG. 7, making use of the invention, it may also be seen that at the end of the expansion process UV the fluid pressure is greater (by VW) than during the discharge process (WX). Thus there is a small loss of potential work due to the underexpansion (to the right of VW).

A further feature which affects the performance of all positive displacement machines, whether operating in expander or compressor mode is internal friction. In all cases efficiency losses associated with it, increase with speed. The best design of expander will therefore involve a compromise between the need for high speed to minimise leakage losses and low speed to minimise friction, a large built-in volumetric expansion ratio to minimise losses due to underexpansion and a small volume ratio to minimise the significance of leakage effects while maximising the mass flow and thereby keeping the size of the expander to a minimum.

The Optimum Built in Volume Ratio

Since performance penalties are incurred both by overexpansion and underexpansion, it might therefore be inferred that the best results would be obtained when the pressure at the end of expansion corresponds exactly with the required discharge pressure. In practice, for a given size of machine operating at a specified speed, there is a choice between a low built-in volumetric expansion ratio with a consequent high induced mass flow and relatively low leakage losses, but some losses due to underexpansion, and a higher built-in volumetric expansion ratio with a lower induced mass flow rate and higher leakage losses but little or no loss due to underexpansion. Raising the rotational speed increases the internal expansion in the filling process and thereby permits an even lower built-in volumetric expansion ratio but increases the friction losses. When all these effects are considered simultaneously, it has been found that if some underexpansion is permitted, high speed, low built-in volumetric expansion ratio designs, with volumetric capacity less than that required for lower speed, full expansion alternatives, attain the highest overall adiabatic efficiencies. When the effect of expansion during the filling process is included, it becomes clear that the required built in volume ratio for optimum size and efficiency is very much less than that of the total expansion process from entry to exit of the machine.

Numerical values for this difference were obtained when considering the replacement of a throttle valve in two large industrial chiller units by either a single or twin screw expander to develop mechanical power.

Figure 8:
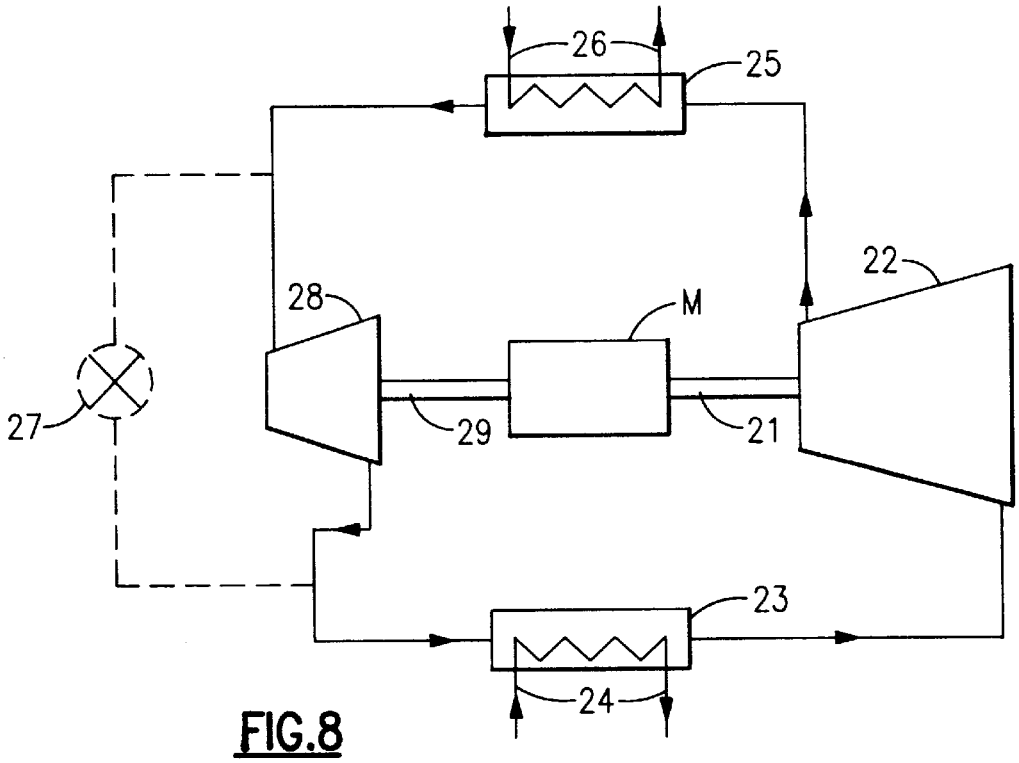
FIG. 8 is a schematic diagram of a refrigeration or chiller system to which the invention may be applied.

The chiller installation shown in FIG. 8 is conventional in that is comprises a drive motor M the shaft 21 of which drives a compressor for compressing refrigerant vapour from an evaporator 23 which removes heat from a chilling circuit 24. The compressor 22 delivers hot compressed vapour to a condenser 25 where it is cooled and condensed into liquid by heat exchange with liquid in a cooling circuit 26.

Conventionally, the liquid refrigerant would have its pressure reduced by being passed through a throttle valve 27 but instead is here expanded (from liquid to vapour) through a two-phase expander 28 in accordance with the invention. The power output of the expander 28 is applied by a shaft 29, either directly or through gearing, to assist the motor M in driving the compressor 22.

The overall volume ratio of expansion for a compressor can be defined as the ratio of the specific volume at the discharge to the specific volume at the inlet of the compressor, wherein the specific volume is the volume of a substance per unit of mass.

Figure 9:
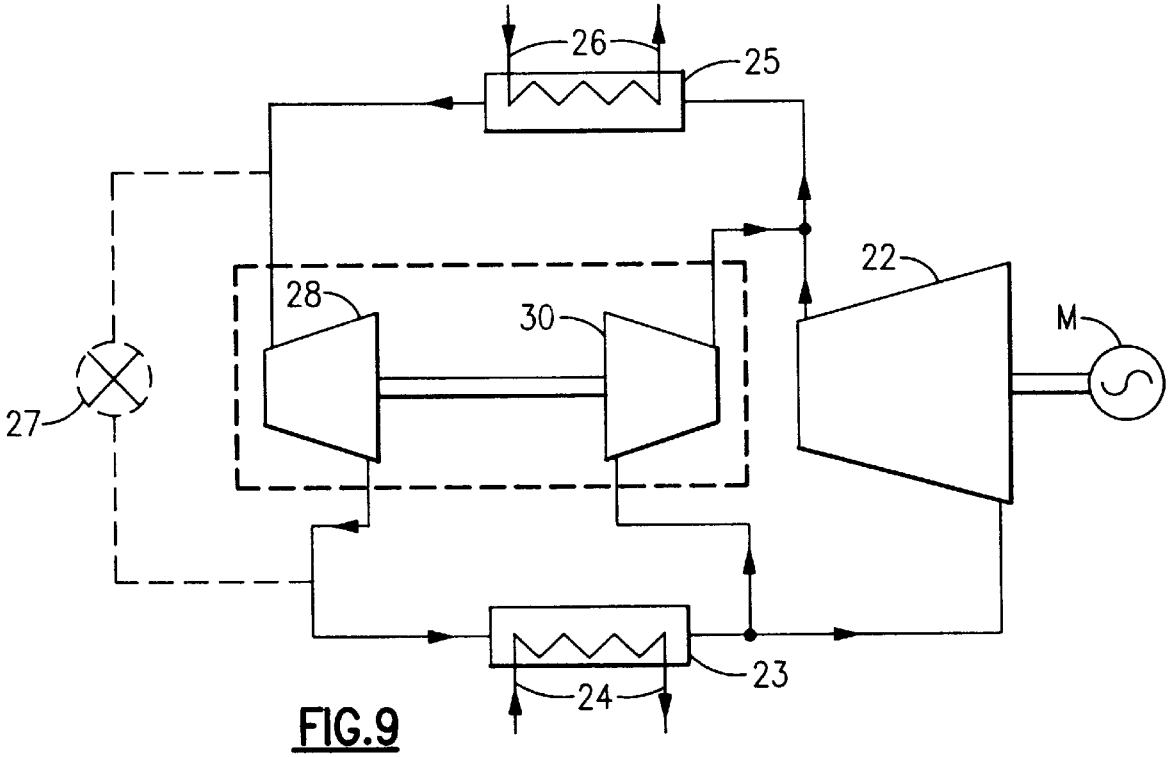
FIG. 9 shows a modification of FIG. 8.

FIG. 9 shows a modification of FIG. 8 in which the two phase expander 28 is arranged to drive a second vapour compressor 30 connected in parallel with the main compressor 22. Both the expander 28 and the second vapour compressor 30 are of the Lysholm twin-screw type. Using Refrigerant 134A as working fluid gives the following results:

| | Overall Expansion Ratio | Optimum Built in Expansion Ratio | % Ratio |
|---|---|---|---|
| FIG. 8 | 13.63 | 3.20 | 23% |
| FIG. 9 | 10.38 | 2.81 | 27% |

In both cases, the adiabatic efficiencies of the expanders were estimated to be over 75%.

Figure 10:
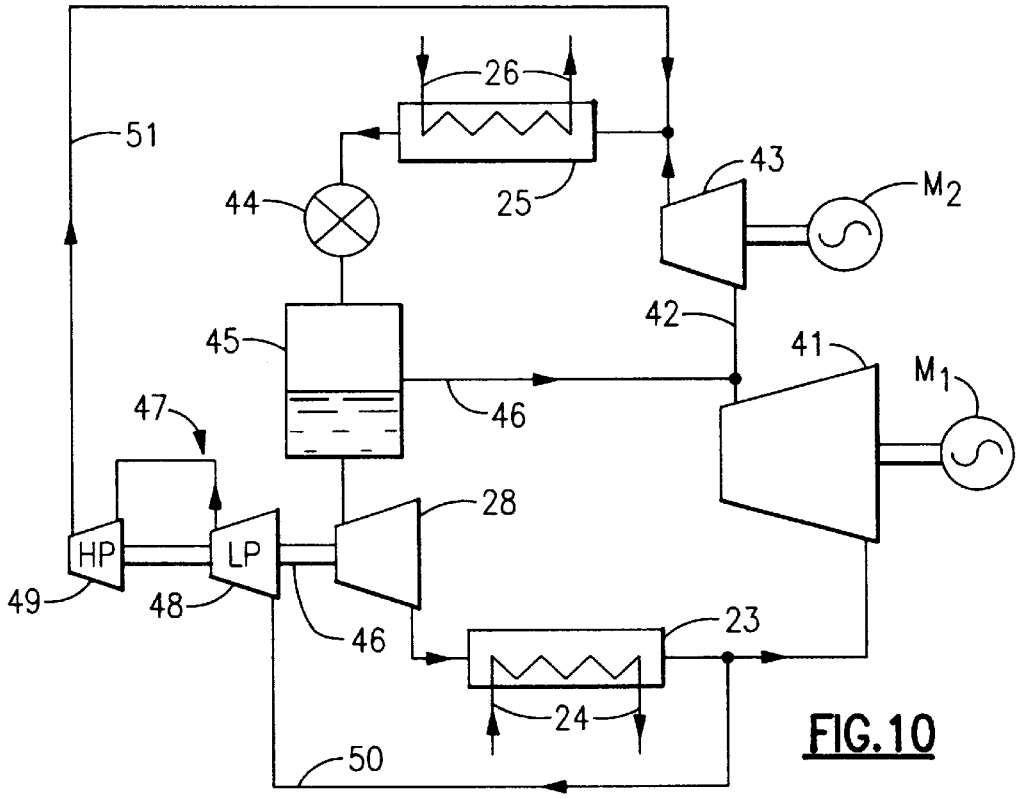
FIG. 10 is a schematic circuit diagram of a heat pump incorporation the invention.

In addition to replacing throttle valves in industrial chillers, positive displacement expanders may be used for the same function in large heat pumps and refrigeration cold stores in identical or related ways such as shown in FIG. 10.

In the arrangement shown in FIG. 10, the main compressor is a two stage compressor which comprises a low pressure compressor 41, driven by a motor M1, the output of which is delivered by a line 42 to the inlet of the second stage, high pressure compressor 43. The output from the condenser 25 is passed through a throttle valve 44 for partial expansion into a vapour/liquid separator 45 from which the vapour is delivered through a line 46 to the line 42 supplying the inlet of the high pressure compressor 43.

The liquid from the separator 45 is delivered to the inlet of the expander 28, the outlet of which is connected to the inlet of the evaporator 23. The output shaft 46 of the expander is connected to drive a two stage compressor 47 consisting of two screw compressors in series constructed as a low pressure stage 48 and a high pressure stage 49. The low pressure stage receives vapour from the evaporator outlet via a line 50 and the outlet from the high pressure stage 49 is delivered by a line 51 to the inlet of the condenser 25.

When used as a heat pump, the circuit 26 is the circuit to be heated by abstraction of heat from the circuit 24.

Figure 12:
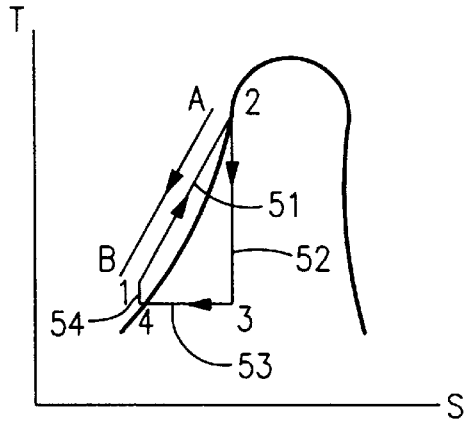
FIG. 12 is a graph of temperature plotted against entropy for the operating cycle of FIG. 11.
Figure 11:
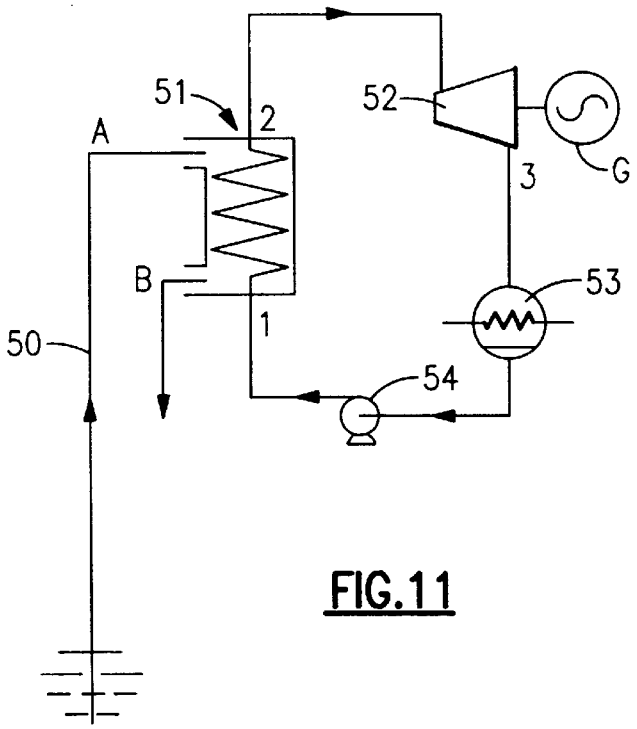
FIG. 11 is a schematic circuit diagram of an installation for generating power from a low grade heat source such as geothermal brine.

Such machines may also be used as the main expander in a system for the recovery of power from low grade heat sources such as geothermal brines, which has been called by the inventors the Trilateral Flash Cycle (TFC) system. The circuit is shown in FIG. 11 and its cycle in FIG. 12. In this case temperature changes and hence volume ratios are much larger and hence two or more expansion stages are needed operating in series. A typical example of this is, as shown in FIG. 11, the case of a supply of hot brine in the form of saturated liquid at 150° C. which is currently being separated from wet steam in a flash steam plant and reinjected into the ground at this temperature. A study showed that by passing the brine from a line through a TFC primary heat exchanger 51 first it could be cooled to 45° C. along the path AB, in counterflow heat exchange with the working fluid before reinjection and 3.8 MW of power could be recovered from the heat withdrawn from it. In this case the working fluid in the system is n-butane with a temperature at the inlet of the expander 52 of 137° C. and a condensing temperature of 35° C. in a condenser 53, the condensate from which is pressurised by a feed pump 54 and returned to the heat exchanger 51. A large two stage twin screw expander system (driving a generator G), was considered to be the most suitable for this purpose, the main features of which are as follows:

| | Rotor Diam mm | Rotor Speed rpm | Pressure Drop bar | Power Output kW | Volume Built in | Ratio Over-all | Adiabatic Effic percent |
|---|---|---|---|---|---|---|---|
| HP Stage: | 390 | 1500 | 15 | 828 | 3.6 | 4.9 | 82 |
| LP Stage: | 620 | 1500 | 12 | 3042 | 3.2 | 7.1 | 80 |

Thus an overall volume ratio of expansion of 34.8:1 was achieved in two stages with an overall built-in volumetric expansion ratio of only 11.5:1, giving a percentage ratio 11.5/34.8=33%. Allowing for inherent reheat effects in multi-stage expanders, the overall adiabatic efficiency of this expander arrangement is 82.2%, which value compares well with that of a dry vapour turbine of equivalent power output. It is noted that such high efficiencies could not be obtained with screw compressors operating directly over equal pressure differences and that the net system output is 35% greater than that claimed for alternative conventional power plant offered for the same function.

We claim:

1. Apparatus for deriving mechanical power from expansion of a working fluid, other than water, from a liquid state at a first pressure to vapour at a second, lower pressure, the apparatus including positive displacement machinery, wherein the built-in volumetric expansion ratio of the positive displacement machinery is between 10 and 50% of the overall volume ratio of expansion experienced by the fluid in the pressure reduction between the entry and the exit of the machinery.

2. Apparatus according to claim 1, wherein the built in ratio is between 20 and 40% of the overall expansion ratio.

3. A method of deriving mechanical power from expansion of a working fluid, other than water, from a liquid state at a first pressure to vapour at a second, lower pressure, the method in positive displacement machinery, wherein the built-in volumetric expansion ratio of the positive displacement machinery is between 10 and 50% of the overall volume ratio of expansion of the fluid in the pressure reduction between the entry and the exit of the machinery.

4. A method according to claim 3, wherein the built in ratio is between 20 and 40% of the overall expansion ratio.

* * * * *